United States Patent [19]

Kerivan

[11] Patent Number: 4,616,773

[45] Date of Patent: Oct. 14, 1986

[54] FORMS FEEDING APPARATUS

[75] Inventor: Leo J. Kerivan, Somerset, Mass.

[73] Assignee: Precision Handling Devices Inc., Fall River, Mass.

[21] Appl. No.: 604,761

[22] Filed: Apr. 27, 1984

[51] Int. Cl.[4] ..... B65H 17/38; B65H 35/10

[52] U.S. Cl. ..... 225/99; 225/3; 225/4; 225/100; 226/74; 226/88

[58] Field of Search ..... 225/2–5, 225/100, 93, 99; 226/74, 128, 75, 88, 194; 242/75.3

[56] References Cited

U.S. PATENT DOCUMENTS

| | | | |
|---|---|---|---|
| 2,140,028 | 12/1938 | Nichols | 197/133 |
| 2,208,994 | 7/1940 | Mabon | 225/3 |
| 2,747,717 | 5/1956 | Cunningham et al. | 197/133 |
| 2,840,217 | 6/1958 | Nelson et al. | 197/133 |
| 3,794,228 | 2/1974 | Colwill et al. | 225/93 |
| 3,859,864 | 1/1975 | Offermann | 74/229 |
| 3,987,949 | 10/1976 | Manning et al. | 225/100 |
| 4,094,451 | 6/1978 | Wescoat | 226/88 |
| 4,129,239 | 12/1978 | Hubbard | 226/75 |
| 4,206,859 | 6/1980 | Plaza | 226/74 |
| 4,213,551 | 7/1980 | Windele | 226/74 |
| 4,214,691 | 7/1980 | Van Namen | 226/74 |
| 4,281,804 | 8/1981 | Badet et al. | 242/75.2 |
| 4,304,345 | 12/1981 | Carlin | 226/74 |
| 4,345,708 | 8/1982 | Hubbard | 226/74 |
| 4,469,262 | 9/1984 | Seitz | 226/74 |
| 4,484,702 | 11/1984 | Sabonis et al. | 226/74 |

FOREIGN PATENT DOCUMENTS

| | | | |
|---|---|---|---|
| 2062806 | 7/1972 | Fed. Rep. of Germany | 226/74 |

OTHER PUBLICATIONS

"Semiautomatic Continuous Forms Loading", W. McNees, *IBM Technical Disclosure Bulletin*, vol. 22, No. 6, 11/1979.

*Primary Examiner*—Frank T. Yost
*Assistant Examiner*—Hien H. Phan
*Attorney, Agent, or Firm*—Martin LuKacher

[57] ABSTRACT

An overhead unit used with a printer having a platen for feeding continuous, fan-folded, edge perforated forms. Tractors engage the feed perforations on the forms. The unit automatically bursts the side perforations by the use of flexural members which extract energy from the forms feed and oscillate to burst the side perforations. Bursting of the cross perforations is carried out by a pivotally mounted, lever actuated bar which engages the platen and forms a toggle therewith to engage the successive forms against the platen just below the cross perforations; the toggle being arranged to tighten and increase the clamping force, as the form is pulled away from the platen when bursting the cross perforations. A roller assembly including rollers engaging the outside of the loop on the infeed or upstream side of the platen removes any platen wave due to differential displacement of the forms as they travel with linear motion through the tractors and with rotational motion around the platen. These rollers also steer the form to counteract lateral meandering thereof on the platen. Other rollers on the infeed side of the tractors wrap the forms to at least a 90° arc to eliminate positive tents at the cross perforations. Backlash is removed by a diagonally split collet and tapered sleeve which controls the clearance between the tractor drive shaft and the sprockets of the tractors. Additional rollers on the drive shaft and the support shaft for the tractors, which can be used together with fingers extending from the support shaft, stiffen the forms between the tractors.

73 Claims, 20 Drawing Figures

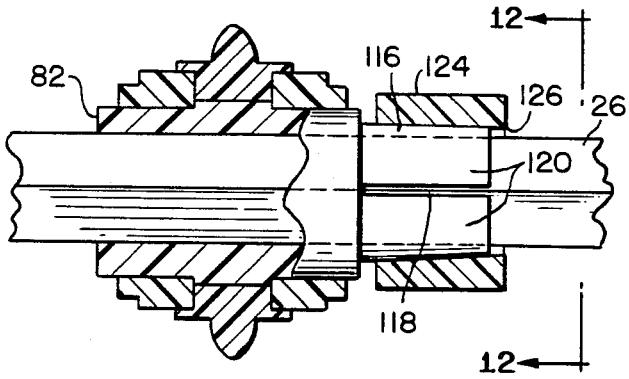
FIG. 11
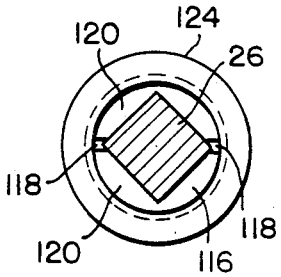
FIG. 12
FIG. 11A
FIG. 11B
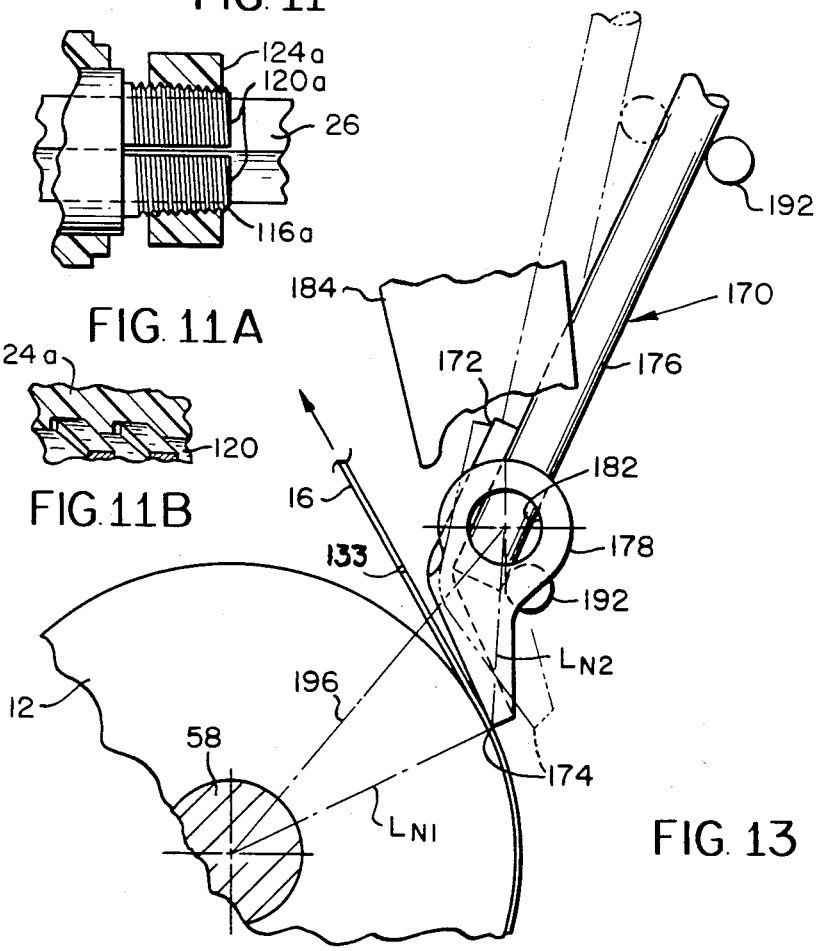
FIG. 13

FORMS FEEDING APPARATUS

DESCRIPTION

The present invention relates to apparatus for feeding edge perforated webs, and particularly for feeding computer forms which are partially severed by side perforations along their margins which contain feed perforations; the forms also being separated by cross perforations which enable them to be fan folded.

The invention is especially suitable for use in an overhead tractor feed unit which adapts printing apparatus, such as typewriters and especially computer printers having platens against which their printing elements work, to use continuous forms which are perforated with feed perforations along their edges. Features of the invention may also be used wherever precision feeding of webs is to be accomplished. Accordingly, the term "forms" as used herein, should be taken to include webs of paper and other materials.

In order to extend the use of computer operated printers, it is necessary to make the handling of forms (the documents, such as checks, receipts, invoices) simple and convenient. The product of computerized data processing is the form produced by the printer. Even though the data can be processed under computer control rapidly and with minimum operator attention, if paper handling of the output from the printer consumes much operator time and effort, much of the convenience and speed of automatic data processing is lost. Computer printers are capable of rapidly printing on continuous, usually fan folded, edge perforated forms which are driven by tractors. The voluminous stacks of forms are difficult to use. The printed material is contained in individual forms which are separated by cross perforations. The margins of the documents which contain the feed perforations are separated from the documents by side perforations. It becomes necessary to burst (detach) manually the side perforations and the cross perforations in order to detach the form to provide a presentable document. Such operations are inconvenient and time consuming. Often the document is ripped in the process of attempting to burst the side and cross perforations.

The problem is exacerbated by the need to maintain high quality printing of sharp images with precision spacing and registration on the forms. The quality printing problem becomes more difficult in the case of multi-part or multi-page forms, especially where the forms are separated by flimsy carbon paper. With multi-part forms, any delamination prevents the printing of sharp, high quality images, and can also result in misregistration of the printing on various pages of the multi-part form.

In addition to the problems of convenience in the handling of the forms, and particularly bursting the perforations thereof and maintaining high quality printing, it is often necessary to adapt a printer having a platen which is designed to feed individual sheets so that it can handle continuous, edge-perforated forms. Tractor feed units are available for this purpose. Platen feed and tractor feed are, to a degree, incompatible. For example, the tractor provides linear motion of the paper while the platen effects rotational motion. If the paper is wrapped tightly around the platen, as is necessary in order to obtain high quality, sharp images, a wave, called the platen wave, forms on the infeed side of the platen. In multi-part forms, such a wave causes delamination and misregistration at the printing point. The differential displacement can also result in excessive tension on the edges of the feed perforations in the tractor which tears the perforations and prevents precision feeding or metering of the forms by the tractor drive. Any backlash or play in the tractor drive is also amplified at the points where the forces are applied to the feed perforations and can cause tearing thereof with consequent misregistration and loss of precision feed of the forms.

Accordingly, it is the principal object of the present invention to provide improved forms feeding apparatus which makes the handling of continuous, edge perforated forms simple and convenient and also provides for precision feeding of the forms to enable high quality printing with precise line spacing and registration, especially on multi-part forms.

It is another object of the present invention to provide improved forms feeding apparatus, useful as an overhead tractor feed unit for a printer having a platen, where the tractor feed takes off power used to drive the platen and does not impose an excessive additional load on the motor and other parts of the platen drive system.

It is a further object of the present invention to provide an improved forms feeding apparatus for handling computer forms having side perforations along the margins thereof which automatically bursts such side perforations without excessively loading the drive system of the apparatus.

It is a still further object of the present invention to provide improved forms feeding apparatus which enables successive forms to be burst along their cross perforations without the need for realignment or rethreading of the forms.

It is a still further object of the present invention to provide improved forms feeding apparatus in which the platen wave is eliminated so as to facilitate high quality printing with precise line spacing and registration, especially on multi-part forms.

It is a still further object of the present invention to provide improved forms feeding apparatus having tractors for feeding edge-perforated, fan-folded forms which have tents as their folds which extend in opposite directions from different sides of the forms at successive folds which tents, which extend towards the lids of the tractors, are reversed or detented so as to facilitate precision feed of the forms by the tractors.

It is a still further object of the present invention to provide improved forms feeding apparatus in which backlash due to excessive clearances between drive shafts and driven rotary elements of the drive system, particularly sprockets of tractors of the apparatus are reduced, simply and effectively.

It is a still further object of the present invention to provide improved apparatus for feeding continuous edge perforated forms with tractors and a platen without misregistration of the forms on the platen and without misalignment of the forms with the tractor feed pins so as to provide high quality printing on the forms at the platen and low torque on the tractor drive.

Briefly described, apparatus embodying the invention and useful for feeding continuous forms utilizes tractors engageable with feed perforations along margins of the forms. The margins are partially severed by side perforations, and successive ones of the forms are separated by cross perforations which also partially sever the forms and enable them to be stacked in fan-folded configuration. The forms feeding apparatus may be used with a platen, normally contained in the printer and the apparatus provided by the invention enables such a platen equipped printer to handle continuous forms. The tractors and the platen are conjointly driven for feeding the forms around the platen and through the tractors. The side perforations are automatically burst by bursting means defined by flexural members and portions of the tractors. The flexural members are preferably cantilever mounted on the lids of the tractors in the path of the forms and oscillate in response to energy derived from the forms feed to repetitively shear the side perforations. Bursting of the cross perforations is accomplished by clamping means including a bar having a longitudinal edge, suitably, manually pivoted by a lever extending from the bar. The bar and the platen define a toggle to increase the clamping force of the bar edge against the platen when the form is pulled outwardly in a downstream direction from the platen and burst along the cross perforations. The platen wave is eliminated by spring biased means which bear against the forms on the outside of the loop of the forms which extends between the opposite sides of the tractors; the tractors engaging the forms as they pass into and out of the loop on the infeed and outfeed sides of the platen so as to facilitate bidirectional feeding. These platen wave eliminating means wrap the form against the platen so that the forms are in driving relationship with the platen. The platen wave eliminating means impose an arc, in the inverse direction and equal to, the arc executed by the forms displaceably wrapped around the platen. The inverse arc compensates for the differential displacement between the linear displacement of the forms in the tractors and their rotational displacement in the platen of the forms, thereby eliminating the platen wave. Roller means, which may be contained in a unitary assembly with the platen wave eliminating means, cause the forms to execute at least a 90° arc prior to entering the tractors and invert and de-tent the forms.

The platen wave eliminating means may be provided by plurality of spring biased rollers laterally spaced along the rotational axis of the platen. These rollers respond to differential tension in the forms arising when they tend to move laterally or skew on the platen. The rollers apply amplified differential forces to the forms to counteract such lateral meandering and maintain the forms aligned on the platen. The forms are also bowed or crowned to increase the stiffness thereof between the tractors and in the region of the forms which is driven by the tractors, thereby facilitating the shearing and bursting of the side perforations.

In order to eliminate backlash in the drive system for the tractors and increase the precision of the metering of the forms, journals extending from the sprockets of the tractors which have holes therethrough for receiving a drive shaft with a corresponding cross section, have slits between a pair of diagonally opposite corners of the cross section. A tapered sleeve compresses the journals and controls the clearance between the journals and the drive shaft thereby preventing any backlash in the journals from affecting the precision feeding of the forms. Both the outer periphery of the slit journals and the sleeve may be tapered and threaded for compressing the slit journals on the drive shaft.

The drive shaft is preferably driven by a stepping motor, and one or more steps are used for each line spacing. The bursting flexure deflects, absorbing energy from the feed (the drive system) when the motor starts, thereby eliminating the starting load. Shearing of the side perforations is delayed and occurs after the motor starts. The elimination of backlash and the removal of the platen wave also reduces the starting load and minimizes the settling time of the drive system, thereby facilitating high speed printing.

The foregoing and other features objects and advantages of the invention, as well as the presently preferred embodiment thereof, will become more apparent from a reading of the following description in connection with the accompanying drawings in which:

FIG. 11 is an enlarged view showing the sprocket of the right hand one of the tractors and illustrating the arrangement for controlling clearance between the journals and tractor drive shaft;

Figure 1:
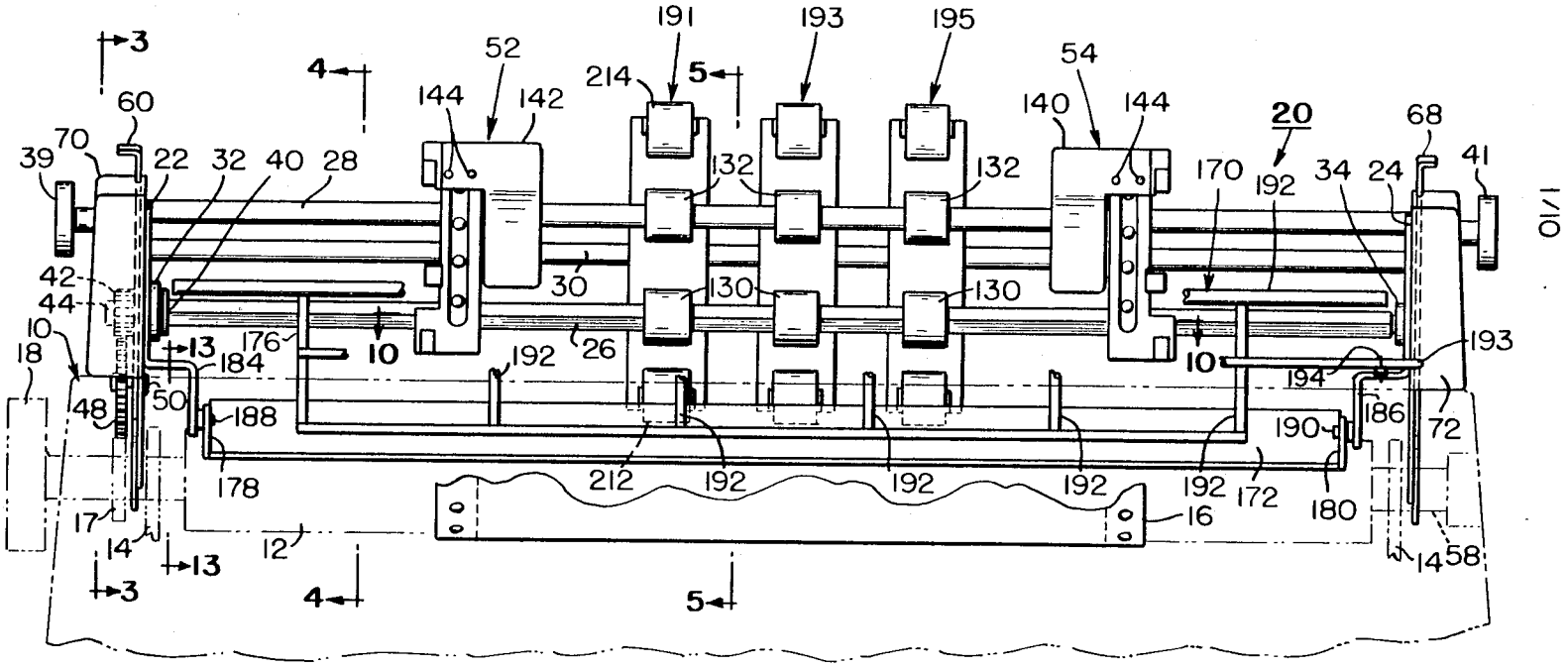
FIG. 1 is a front view illustrating in solid lines continuous forms feeding apparatus, embodying the invention, which is being used as an overhead unit on a printer, shown in lines consisting of long and short dashes.
Figure 3:
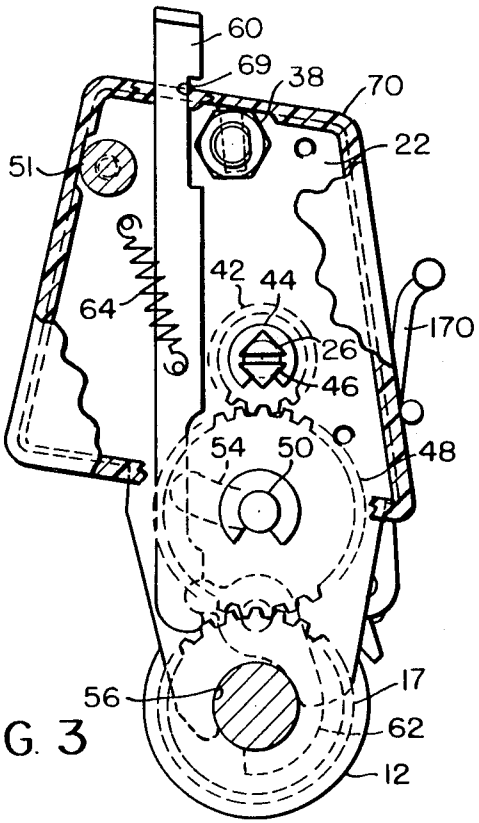
FIG. 3 is a fragmentary, sectional view taken along the lines 3—3 in FIG. 1 and showing, in greater detail, the gear system and mechanism for attaching the overhead unit to the printer.
Figure 2:
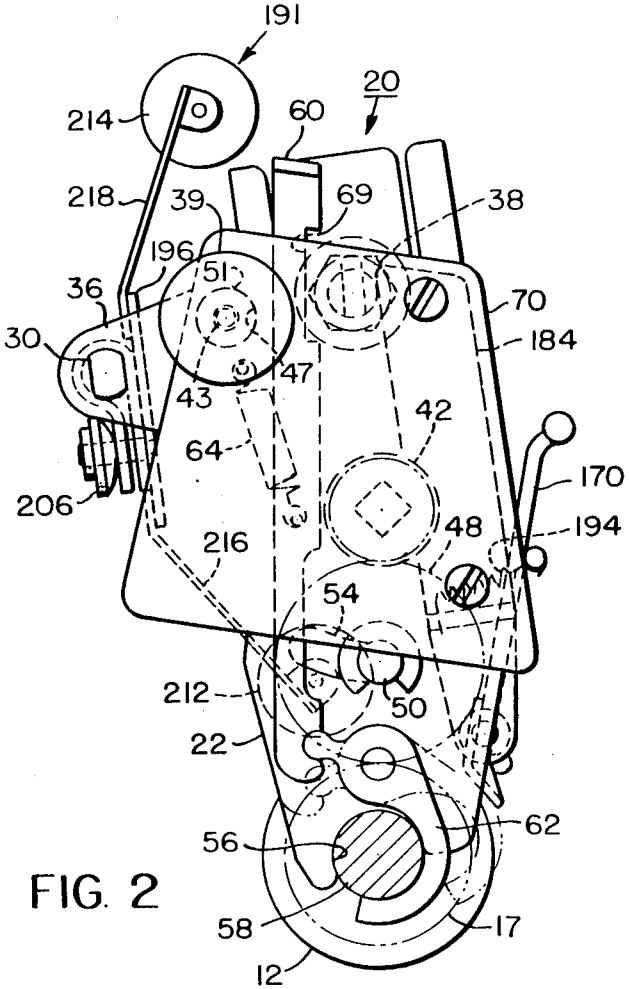
FIG. 2 is a left end view of the overhead unit shown in FIG. 1.
Figure 15:
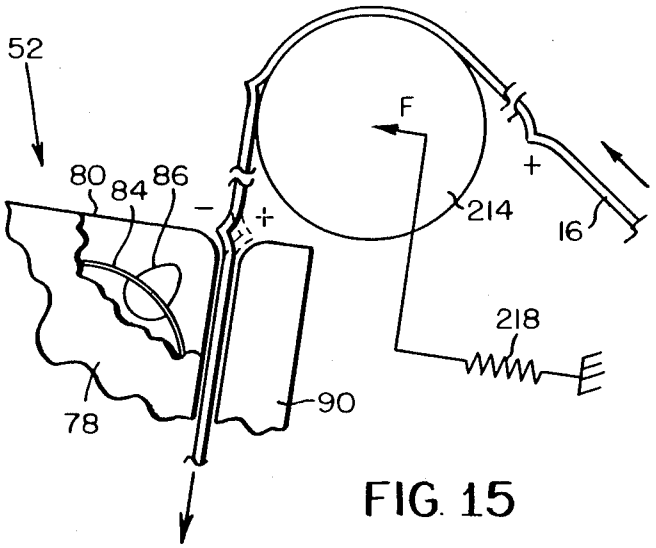
Figure 14:
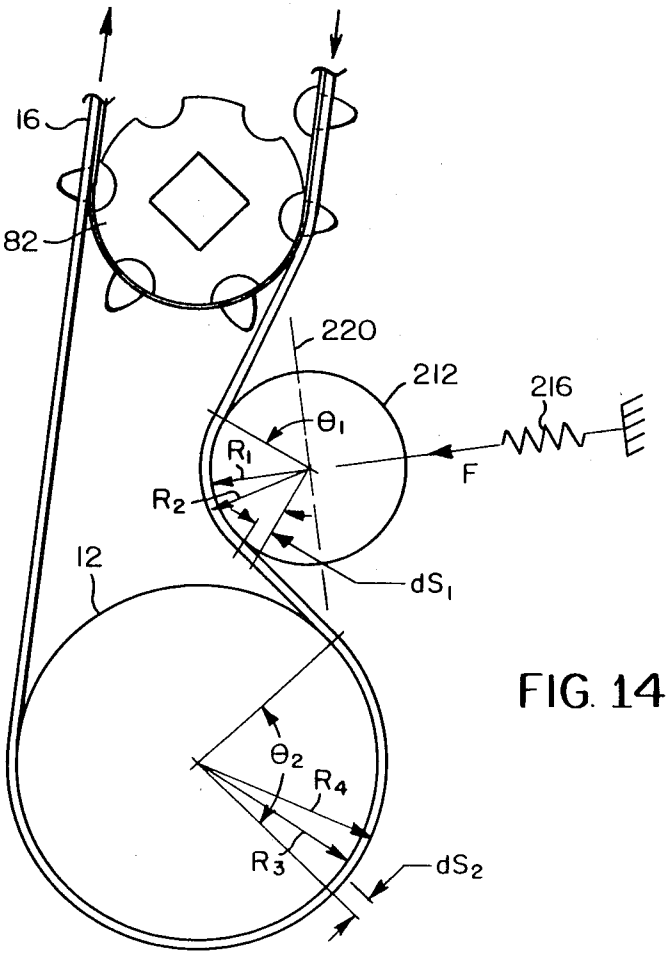
Figure 16:
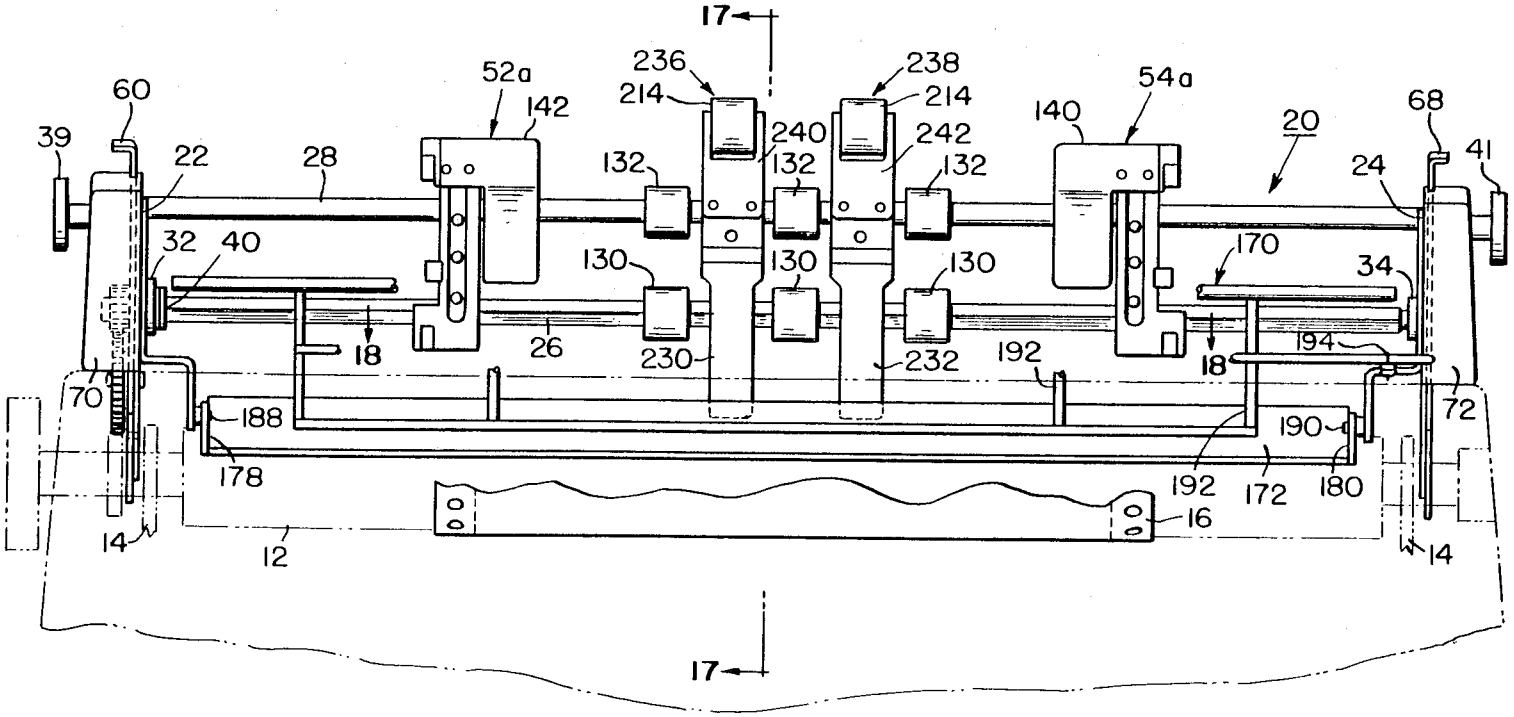
Figure 17:
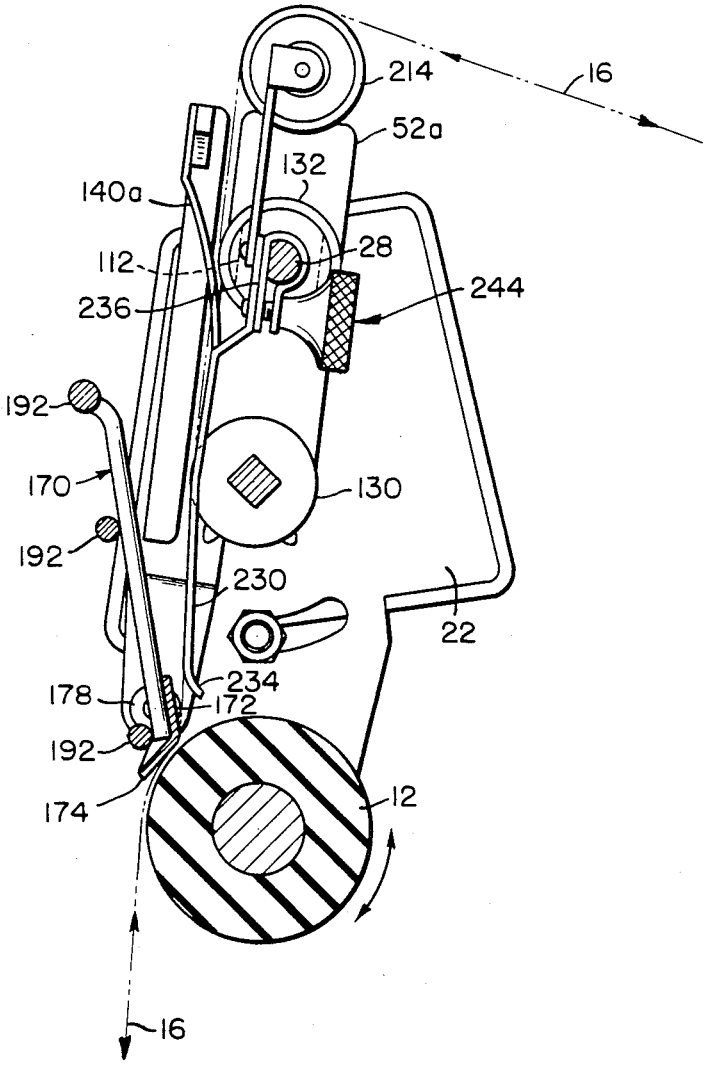
Figure 18:
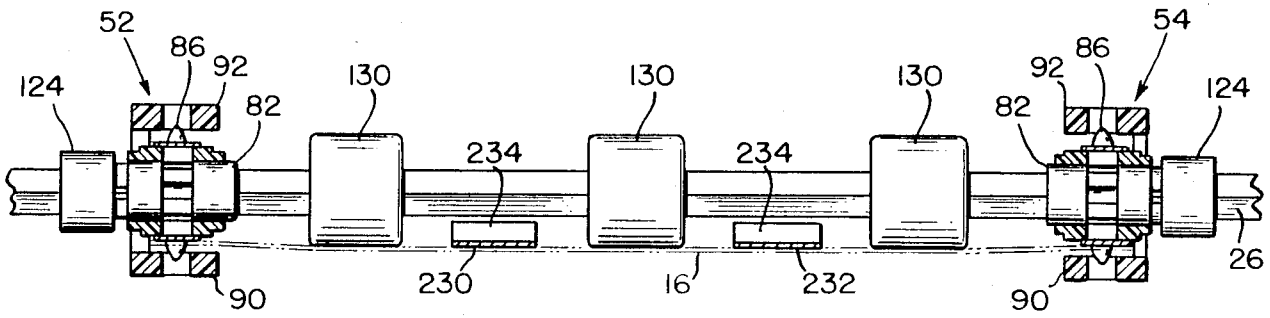

FIGS. 11A and B are fragmentary sectional views similar to FIG. 11 showing modified collet and sleeve arrangements;

FIG. 12 is a sectional view taken along the line 12—12 in FIG. 11;

FIG. 13 is an enlarged, fragmentary view taken generally along the lines 13—13 in FIG. 1;

FIG. 14 is a diagrammatic view illustrated of the system for compensating for the platen wave which is used in the overhead unit illustrated in the previous Figures;

FIG. 15 is a diagrammatic view illustrated of the operation of the de-tenting rollers used in the overhead unit shown in FIGS. 1 through 13; and FIGS. 16, 17 and 18 are views similar to FIGS. 1, 5 and 10 which illustrate forms feeding apparatus in accordance with another embodiment of the invention wherein bi-directional feed with single lid or unidirectional tractors where the forms enter or exit the printer from below the platen.

Referring to FIGS. 1 through 15 the drawings, and initially to FIGS. 1 through 6, there is shown a printer 10 having a platen 12 which is rotatably mounted on a frame 14 of the printer. The printer is of the type which impacts with its print head (whether type bars, daisy wheels, dot matrix wires, etc.) on the forms. The platen 12 may have a surface of soft material such as rubber or other compliant material, as is conventional. The form 16 is fragmentarily shown wrapped around the bottom of the platen 12 in FIG. 1. The platen 12 has a gear 17 which is driven by the drive system on the printer, suitably through other gears from a stepping motor. Manual rotation of the platen and the other parts of the overhead unit may be accomplished by means of a knob 18.

General information respecting forms feeding units and the printers with which they are used may be found in U.S. Pat. No. 4,345,708 issued Aug. 24, 1982 to L. J. Hubbard. The feeding units may be separable from the printers, as shown in the above referenced Hubbard patent and also in the following U.S. Pat. Nos.: 4,304,345 issued Dec. 8, 1981; 3,859,864 issued Jan. 14, 1975; 4,214,691 issued July 29, 1980 and 2,140,028 issued Dec. 13, 1938. They also may be integral with the printer, as shown in U.S. Pat. Nos. 4,213,551 issued July 22, 1980; 4,281,804 issued Aug. 4, 1981; and 2,747,717 issued May 29, 1956; 2,840,217 issued June 24, 1958 and 4,010,882 issued Mar. 8, 1977. It will be appreciated that while the invention in accordance with a preferred embodiment thereof is used in an overhead unit separable from the platen, the invention may provide forms feeding apparatus which is an integral, assembled part of the printer.

Figure 4:
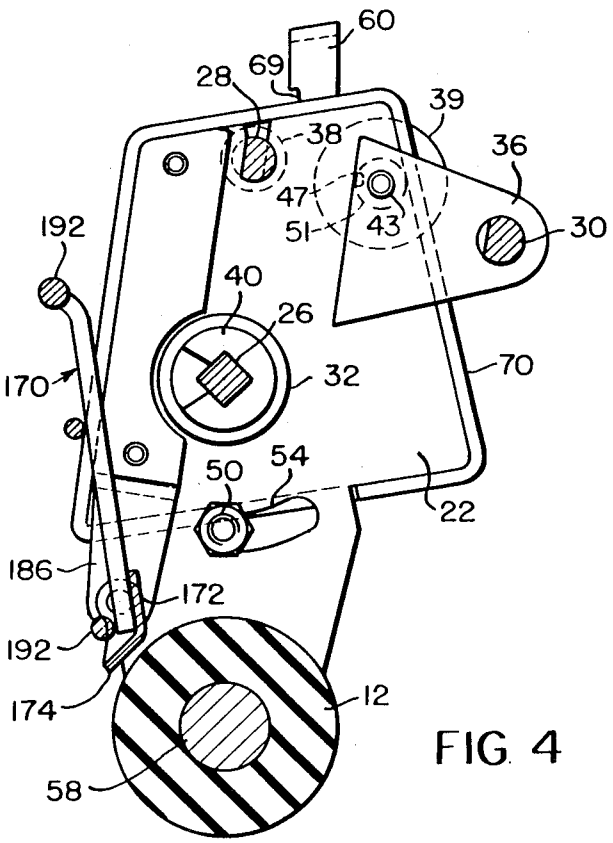
FIG. 4 is a sectional view taken along the lines 4—4 in FIG. 1.

The overhead unit 20 has a framework provided by side plates 22 and 24, spaced laterally from each other by a driven shaft 26, a support shaft 28 and a "D"-shaped support bar 30. The drive shaft 26 is a rectilinear, square shaft which is rotatably mounted in journals 32 and 34 in the side plates 22 and 24. Polygon or splined drive shafts may also be used. The support bar 30 is mounted on brackets 36 and 38 extending rearwardly from the side plates 22 and 24 (See FIGS. 4, 5 and 6). The opposite ends of the support shaft 28 are threaded and held to the side plates by nuts 38 (See FIG. 3). The brackets 36 and 38 are pivotally mounted on bolts 43 and 45 which define shoulders with cylindrical rods 53 and 51. Portions 47 and 49 of the rods 51 and 53 extend through the covers 70 and 72. The bolts are threaded into tapped, internally threaded holes in the brackets 36 and 38 (FIGS. 4 & 5). The bolts 43 and 45 are turned by knobs 39 and 41 on the exposed ends of the rods 53 and 51. The bolts 43 and 45 extend through holes in the side plates, and the shoulders of the rods 53 and 51 bear against the side plates 24 and 22. When the bolts are loosened by turning their knobs 39 and 41, the support bar 30 and the brackets 36 and 38 can pivot and be adjusted with assemblies 191, 193 and 195 which are attached thereto. When the knobs are tightened, the brackets 36 and 38 are clamped to the side plates 22 and 24 against the shoulders at the ends of the rods 53 and 51.

Bearings are disposed in the journals 32 and 34. A shoulder on the right hand end of the drive shaft 26 restricts its movement to the right in the direction of the right hand support plate. Movement towards the left is restricted by a thrust washer or E-ring 40 on the outside of the journal 32 in the left-hand side plate 22. A drive gear 42 is mounted to the left-hand end of the drive shaft 26 on the outside of the plate 22. The journal of this gear has a cylindrical outer periphery which turns in the bearing in the journal 32. The drive gear 42 is held on the drive shaft 26 by a C-washer or E-ring 44. In order to control the clearance between the drive shaft 26 and the journal of the drive gear 42, the left hand end of the drive shaft 26 is diagonally slit between its corners. A shim 46 is inserted in the slit to take up any clearance, thereby reducing backlash in the drive system (See FIG. 3).

The drive to the platen gear 16 is through an idler gear 48. The stud 50 for the idler gear 48 is adjustably mounted in a slot 54 in the side plate 22 so as to position the idler gear for mimimum backlash.

A pair of tractors 52 and 54 are mounted on the drive and support shafts 26 and 28. The support shaft 28 may be "D" shaped. These tractors are preferably of a design described in U.S. patent application Ser. No. 407,020 filed Aug. 11, 1982 in the name of L. J. Hubbard, et al., now U.S. Pat. No. 4,457,463, issued July 3, 1984. The tractors advance the form 16 by an amount equal to the line spacing. The ratio of the gears 16, 48 and 42 in the gear train is selected so that the tractors advance the forms 16 the desired line space distance from each step of the stepping motor in the printer. The linear displacement of the tractors controls the line spacing.

The lower end of the side plates 22 and 24 have a circular notch 56 which receives the platen shaft 58 when the unit 20 is mounted in place. Each side plate 22 and 24 has a notch and a locking mechanism consisting of a release lever 60 which is linked to a pivotally mounted hook 62. The release levers are guided by slots in covers 70 and 72 (See FIG. 3) and biased by springs 64 in an upward direction which pivot the hooks 62 into a closed position around the platen shaft 58. To release the unit 20, both the release lever 60 on the left side plate 22 and the release lever 68 on the right side plate 24 are depressed. The unit 20 may then be lifted upwardly out of the printer 10. The covers 70 and 72 cover the gears and other parts of the release mechanism which are exposed when the unit 20 is in place on the printer 10.

Figure 7:
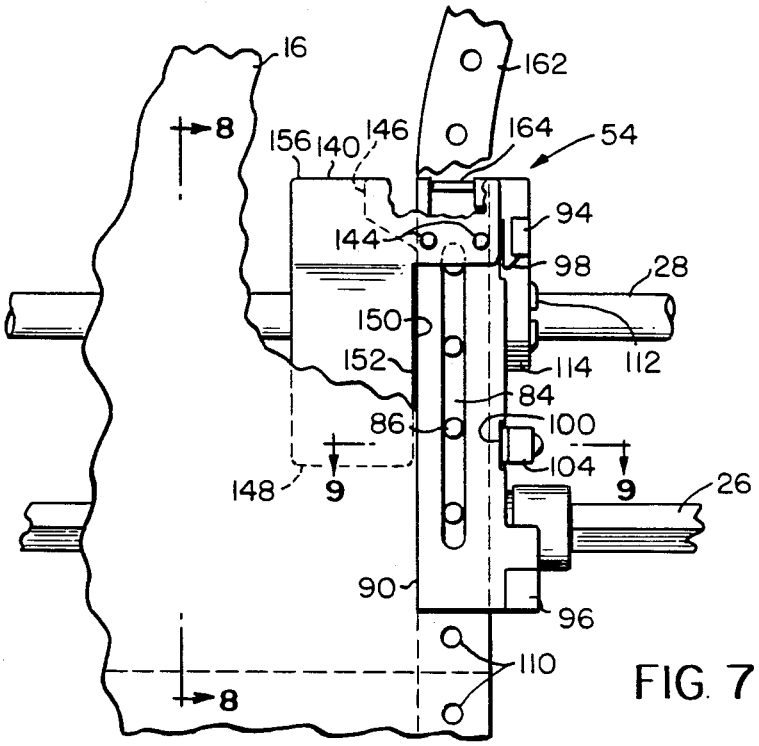
FIG. 7 is an enlarged fragmentary view illustrating, in greater detail, the tractor with its side perforation shearing means.
Figure 8:
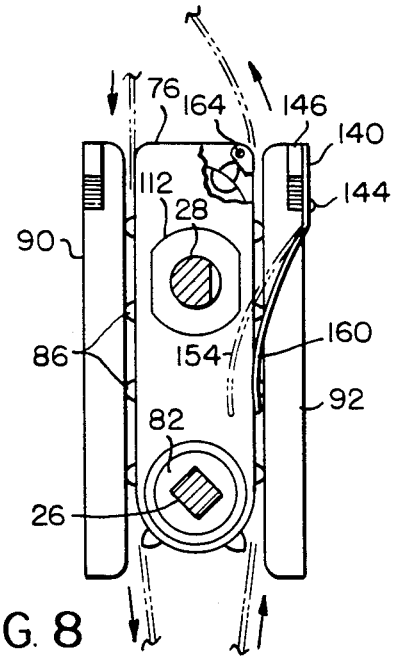
FIG. 8 is a fragmentary sectional view taken along the lines 8—8 in FIG. 7.
Figure 9:
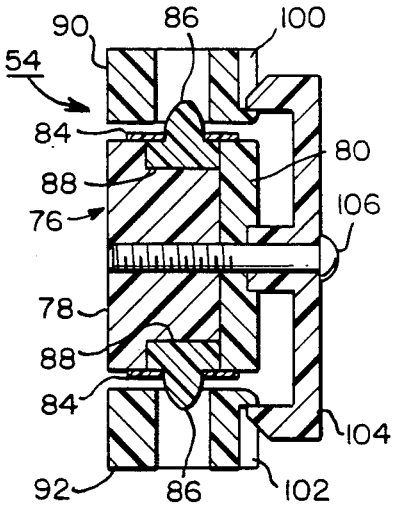
FIG. 9 is a fragmentary sectional view taken along the lines 9—9 in FIG. 7.

The left hand tractor and the right hand tractor 54 are mirror images. Their design is similar and is best shown in FIGS. 7 through 9. The tractors each have a frame or body 76 made up of two plates 78 and 80. A sprocket 82 is journaled in the body 76. Each tractor has a belt 84 from which drive pins 86 extend. (See also FIG. 10) The drive pins have integral drive elements 88 which are engaged with the sprocket and drive the belt. The feed perforations in the forms receive the drive pins 86 in driving relationship. The forms are held down on the belt by lids 90 and 92 which are pivotally mounted in journals 94 and 96 (FIG. 7) and latched in place by a detent 98. Notches 100 and 102 cooperate with a detent latch 104 to hold down the lids 90 and 92. The lids may be flipped 180° to enable threading of the forms 16 thereon. A screw 106 holds the plates 78 and 80 of the frame 76 together. A collet clamp mechanism clamps the tractors in place on the support shaft after they are adjusted in lateral position so that the pins 86 are in alignment with the feed perforations 110 on the margins of the forms 16. The collet clamp mechanism is described in the above-referenced Hubbard et al. application, now U.S. Pat. No. 4,457,463 and also in Hubbard U.S. Pat. No. 4,129,239. The collect 112 of this mechanism and the clamping sleeve 114 which is rotatable thereon are best shown in FIGS. 7 and 8.

Referring especially to FIGS. 11 and 12, a mechanism is shown for controlling the clearance of the sprocket 82 on the drive shaft 26. The mechanism effectively removes any backlash in the drive between the drive shaft and the tractor belt so as to precisely feed the forms 16. The sprocket 82 has a journal 116. The hole of rectilinear (square) cross section for receiving the square drive shaft 26 extends through the sprocket 82 and the journal 116. The journal 116 is provided with a pair of slits 118 which extend radially from diagonally opposite ends of the corners of the hole which receives the square drive shaft 26. These slits define a collet in the journal 116. The collet has two fingers, cylindrical on the outside periphery thereof and having two sides of the square hole on the inner periphery thereof. The cylindrical outside periphery is preferably tapered to a smaller diameter away from the sprocket 82. This causes the force to be distributed uniformly on the collet when it is closed. A tapered sleeve 124, having an internal taper with its smallest diameter end 126 outward from the sprocket 82, closes the collet fingers to control the clearance between the journal 116 and the shaft 26. Closing motion and force is centered on the diagonal 90° from the slits 118. A sliding fit is provided on the shaft 26 so as to enable the tractors to be shifted laterally to accommodate forms of different width. The clearance is minimal and the backlash in the drive between the drive shaft 26 and the tractor belt is eliminated. It is important that only one pair of slits be provided. Then, the fingers 120 cause a takeup of the clearance on all four sides of the square, collectively, proportionally and concentrically.

Referring to FIG. 11A, the fingers 120*a* of the collet have a tapered external thread. The sleeve 124*a* has a tapered internal thread. By turning the sleeve 124*a* with respect to the sprocket 82, the clearance on the shaft 26 may be taken up and backlash eliminated. The threaded arrangement of FIG. 11A has the advantage of being implementable with part of smaller axial length than is the case with the arrangement shown in FIG. 11. Other thread shapes, such as modified square thread and buttress thread may be used to optimize the compression of the collet. FIG. 11B shows a thread in the tapered outer periphery of the collet fingers 120 which is flat on the top, which is the closing pressure surface of the collet. The sides of the threads, which are the driving pressure surfaces of the collet, are from 60° to 90° to the top of the thread. There is nominally no clearance between the surfaces of the internal grooves in the tapered sleeve and the flat tops of the thread on the collet. This arrangement provides for uniform distribution of the closing forces on the collet.

Figure 5:
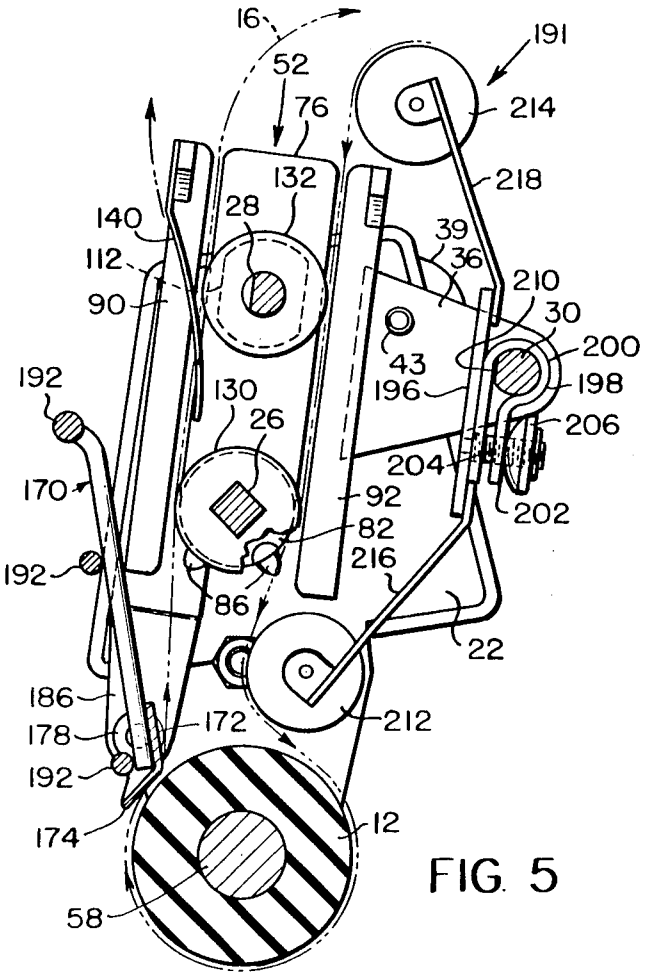
FIG. 5 is a sectional view taken along the lines 5—5 in FIG. 1.
Figure 6:
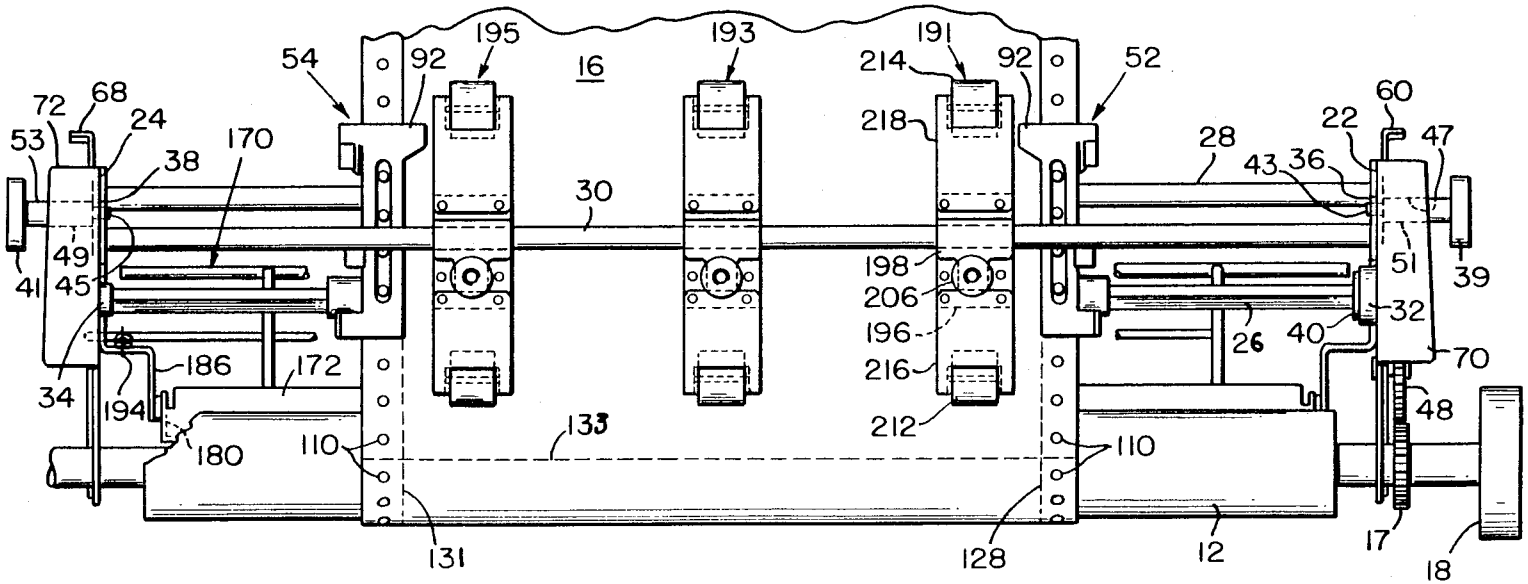
FIG. 6 is a rear elevation of the overhead unit shown in FIG. 1 which also illustrates the platen, but not the rest of the printer.

The path of the forms is shown best in FIGS. 5 and 6 where the tractors are arranged for bidirectional feeding of the forms, pushing the forms downwardly from the upstream direction towards the platen 12 and pulling the forms upwardly in the downstream direction. A loop is formed between the tractors and the platen with the ends of the loop constrained at the end of the tractors. The forms may enter from a fan-folded stack (not shown). FIG. 6 illustrates the side perforations 128 and 131 which separate the portion of the forms on which printing may take place from the margins of the forms which contain the feed perforations. The forms are partially severed at these side perforations.

The forms are also partially severed and successive forms are separated from each other by cross perforations 132. Each of the cross perforations forms a tent. Alternate tents are in the same direction and adjacent tents are in opposite directions. The tents which face the lids of the tractors are called positive tents while the tents which face the belts are called negative tents (see FIG. 15). Bidirectional feed, utilizing opposite reaches of the belt in their linear paths below the lids 90 and 92 of the tractors 52 and 54, is presently preferred in order to obtain bidirectional feeding which is especially useful in the graphics mode of operation of the printers. For printing on successive lines unidirectional feed utilizing only one reach of the tractor, opposite to the upper lid 90 is sufficient. Then, the forms may be fed into the platen from below or behind the platen and upwardly in the downstream direction through the tractors below the upper lid. Feeding in this mode (see also FIGS. 16–18) may also be used for bidirectional feed when the forms are bowed or crowned to stiffen them in the region between the tractors 52 and 54 where the driving forces are applied to the forms. This bowing or crowning increases the section modulus of the forms 16 so that they may be both pushed and pulled by the same reach of the belt of the tractor.

Figure 10:
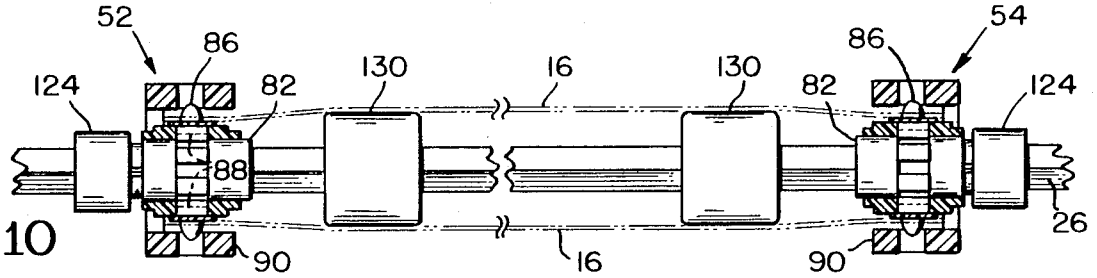
FIG. 10 is a fragmentary sectional view taken along the lines 10—10 in FIG. 1 and showing the bowing or crowning of the forms in the region between the tractors.

The bowing of the forms is accomplished, as best shown in FIGS. 1 and 10, by means of a plurality of rollers 130 (suitably three rollers) which are spaced from each other and rotatable with the drive shaft 26. These rollers have square holes, or can have round holes with a friction fit to the square drive shaft, so that they rotate therewith. The radius of the rollers 130 is greater than the radius of the sprockets. In other words, the pitch diameter of the sprockets 82 and feedbelt 84, which defines the radial distance between the forms and the axis of the drive shaft, is less than the diameter of the bowing rollers 130.

So that the stiffening and bowing of the forms 16 continues through substantially the entire length of the tractors, another set of rollers 132 are rotatably mounted on the support shaft 28. These rollers 132 are aligned with the rollers 130. The diameter of the rollers 132 is preferably the same as the diameters of the rollers 130 so as to maintain the bowing or crown in the forms. The two sets of rollers 130 and 132 also serve to guide the forms over the overhead unit 20. Another function of the rollers and the stiffening of the forms accomplished by them is to facilitate the bursting of the side performations as the forms are driven past the tractors 52 and 54.

To accomplish side perforations bursting automatically while the forms are driven and without imposing an excessive load on the printer motor and other parts of the drive system, flexural members 140 and 142 are used. These flexural members are L-shaped strips of spring steel material with the leg of the L attached, suitably by rivets 144 to the top lids 90 of the tractors 52 and 54. The lids (see FIG. 7) have wings 146 which add further support to the flexural members 140. The flexural members form a ramp intersecting the yhr path of the forms. This ramp is preferably a curve and may suitably be a sector of a circle 45°–60° long. The curve brings the leading end 148 of the flexural member 140 just below the lower side of the forms. The inside longitudinal edge 150 of the flexural member and the lid portion of the tractor, particularly the outside edge 152 of the side of the lid 92 which faces the tractor belt 84 and the outer side of the forms 16, provide the blades of a shear.

In operation as the forms are advanced by the tractors. The flexural members 140 and 142 are depressed. The depressed position is shown in dash lines at 154 in FIG. 8. Each flexural member is a cantilever spring; being cantilever mounted at its down stream end 156. As the forms move stepwise, the members 140 and 142 are bent further and further storing energy with each stepwise movement of the forms. Late in each step and between steps, the flexural members spring back to the position shown at 160 in FIG. 8, bursting the side perforations in the process. The bursting action takes place after the initial acceleration of the forms, thus the shearing load does not add to the starting load on the motor. The flexural members oscillate back and forth, storing energy and releasing it. Since energy is stored continuously in each step, the additional load on the drive is not an instantaneous load but is spread in time. The average increase in load is small and does not overload the motor or the other parts of the drive system associated therewith. The flexural members 140 and 142 on each tractor are offset slightly (say one thousandth of an inch) in the direction of travel of the forms. Shearing of the side perforations by one of the members is therefore delayed with respect to bursting by the other flexural member. The peak energy extracted from the tractor drive is reduced and spread over a longer time duration thereby reducing the load on the tractor drive motor.

As the side perforations are bursted, the marginal strips 162 are guided over a pin 164 (see FIGS. 6 & 8) between the side plates 78 and 80 at the downstream or outlet end of the tractors. The strips may fall into a basket out of the way of any of the mechanisms of the overhead unit 20.

In order to enable the cross perforations 132 (FIG. 6) to be burst, a clamping mechanism 170 is used. This mechanism appears in FIGS. 1 through 6 and in enlarged view in FIG. 13. A bar 172 extends in the axial direction along the rotational axis of the platen 12. The bar has a leading edge 174 (FIGS. 4, 5 and 13) which is manually actuable by a lever arrangement 176 (FIG. 1) into engagement with the platen to clamp the form against the platen 12. The bar 172 has end-brackets 178 and 180 with holes 182. Z-shaped brackets 184 and 186 are attached to the side plates 22 and 24, respectively. Studs 188 and 190 are attached to these brackets 184 and 186. These studs enter the holes 182 and pivotally mount the bar 172 for rotation about an axis parallel to the axis of rotation of the platen 12.

The lever arrangement 176 (FIG. 1) is provided by a frame provided by a matrix of rods 192 which are welded together and to the upper leg of the bar 172. A spring 194 (see FIGS. 1 and 6) biases the frame 176 and the rod 172 in a clockwise direction as shown in FIGS. 4 and 5 so as to bring the clamping edge 174 away from the platen. An extension 193 from the upper horizontal one of the rods 192 provides a limit or stop against the side plate 24.

The bar is concave in shape forming an included obtuse angle, suitably 130° to 140°. The convex shape serves to stabilize and guide the form as they leave the platen, into the tractors 52 and 54. As best shown in FIG. 13, the pivotal axis of the bar 172 is disposed with respect to the rotational axis of the platen 12 to define the base 196 of a triangle. The sides of the triangle indicated as $L_{N1}$ and $L_{N2}$ are defined between the axis of the platen 12 and the pivotal axis of the bar 172 and the clamping edge 174 of the bar where it engages the platen and applies clamping force against the forms 16. It will be seen, therefore, that a toggle linkage is formed by the platen 12 and the bar 172 because the platen rotates and the bar has a pivotal mounting. Then, as the form is pulled in the downstream direction away from the platen, the toggle tends to close, increasing the clamping force at the edge 174 against the form.

In normal printing operations, the forms are advanced and stopped just where the cross perforations 132 leave the platen. At this time the side perforations have been partially burst by the flexural members 140 and 142. The forms are then grasped by one hand while the lever 176 is rotated to apply clamping force against the forms with the longitudinal edge 174 of the clamping bar 172. The free form is then pulled upwardly. This bursts the remainder of the side perforations as well as the cross perforation 132 separating the form. The margins containing the side perforations are still retained in the tractors. Therefore, upon initiation of printing operations, the forms are continually advanced without the need for rethreading the forms in the tractors.

The support bar 30 which is spaced rearwardly of the tractors by the brackets 36 and 38 (FIGS. 1 through 6) supports three assemblies 191, 193 and 195 of yieldably mounted rollers. Each of these assemblies is identical so that only one need be described in detail. Considering the assembly 191 (FIG. 5), it is made up of a support plate 196 to which a clamp 198 is attached. This clamp may be riveted to the plate 196 and defines a loop 200 closed by a spring finger 202. The support bar 30 passes through the loop in the clamp 198. A threaded standoff 204 is mounted on the plate 196 and extends standoff 204 is mounted of the plate 196 and extends through the finger 202 of the clamp 198. A knob 206 is threaded on the stud 204. By screwing down on the knob 206, the clamp 198 may be tightened on the support bar. By loosening the knob 206 the clamp may be released allowing the assembly 190 to be moved laterally along the support bar. A flat 210 on the support bar prevents rotation of the assembly 190. The assemblies are pivotally adjustable with the brackets 36 and 38, in which the support bar 30 is mounted. To effect this adjustment the knobs 39 and 41 are turned to loosen the brackets in the bolt ends 43 and 45. Then the brackets 36 and 38 and the assemblies 191, 193 and 195 are pivoted. During loading of the forms 16, the rollers 212 may be pivoted away from the platen. Then the assemblies are pivoted about the axis of the bolts 43 and 45 and knows 39 and 41 to precisely align the rollers 212 and 214 thereof so as to provide the necessary arcs in the wraps of the forms thereabout, as is described in detail in connection with FIGS. 14 and 15. The knobs 39 and 41 are then turned to tighten the bolts and to hold the brackets 36 and 38 in tight engagement with the side plates 22 and 24.

The rollers 212 and 214 are supported by spring means, namely flexures 216 and 218, which are contilever mounted to the plate 196 at one end thereof; being riveted to the plate 196. The other ends of the flexures 216 and 218 are connected to the rollers 212 and 214 by pins through which the journals of these rollers extend; the rollers thereby being rotatably mounted on the flexures.

The rollers 212 of the assemblies 191, 193 and 195 remove the platen wave. These rollers are disposed between the infeed or upstream side of the platen 12 and the tractors 52 and 54. The rollers engage the outside surface of the forms while the platen 12 engages the inside of surface the forms. In other words opposite surfaces of the forms are engaged by the platen wave rollers 212 and the platen 12. Where the forms are bidirectionaly fed, by being engaged by the tractors both on infeed or upstream and on the outfeed or downstream sides of their path, there is linear metering by the tractors. Instead of using the same tractor to feed the forms, as shown in the drawings, two pairs of tractors may also be used for bidirectional feed (see Hubbard U.S. Pat. No. 4,345,708, referenced above).

The forms define a loop around the platen 12 with the ends of the loop under tension at the infeed and outfeed sides of the tractors. This is the location where the forms leave and enter the tractor sprockets 82 (see FIGS. 5 and 14). Heretofore, with such bidirectional feeds the tension in the loop was adjusted so as to enable the forms to slip on the platen. Inasmuch as the forms were not tight against the platen when impacted for printing, image quality was adversely affected. In multipart forms print quality on the inside pages of the form was even more severely affected. When the tension is increased to improve the print quality, the platen wave phenonmean enused. The platen executes rotational motion. Thus, for any given linear displacement of the forms by the tractors, there is a slightly different displacement at the platen.

This displacement builds up causing a platen wave on the infeed or upstream side of the platen. With multipart forms, since each part moves a different distance around the platen due to the progressively greater displacement from the axis of the platen of each successive page or layer, the forms delaminate and shift longitudinally (in the direction of travel). This causes misregistration on printing. A further disadvantageous result of the platen wave is that the perforations in the form are misaligned with the pins of the tractor belt when they exit the platen. This requires more torque from the drive system to push the pins into the perforations and may even tear the perforations.

The platen wave rollers 212 compensate for and eliminate the platen wave, while providing for a tight wrap of the forms on the platen. The rollers 212 are disposed (see FIG. 14) so as to provide the tension necessary to wrap the forms in frictional driving relationship with the platen. The position of the rollers as set by the adjustment of the assemblies 190, 192 and 195 of which they are a part, is such that the axis of the roller 212 is intermediate and preferably bisects a line (indicated at 220 in FIG. 14) where the forms leave the sprocket (are tangent to the sprocket) and where the forms enter the platen (are tangent to the platen). The flexure 216 applies a force indicated as "F" in FIG. 14, in a direction perpendicular to the line 220. This force provides the tension necessary to wrap the forms for platen drive. The platen wave rollers 212 compensates for the platen wave by causing the forms to execute an arc of 90° shown as $\theta_1$. This arc, $\theta_1$, may be less than 90°, if the arc of the forms around the platen 12 is also less than 90°. No more than a 90° arc, $\theta_1$, is found to be needed, based on the observation that the displacement of the form occurs over an arc of 90° on the platen. It can be shown that a form of thickness $(R_2-R_1)$ equal, of course to $(R_4-R_3)$ in executing a conterclockwise arc $\theta_1$ around the platen roller 212 is displaced a distance, $dS_1$, which is of opposite sign to the displacement distance, $dS_2$, of the form when it executes an arc $\theta_2$ equal to $\theta_1$, in the opposite sense around the platen 12. Since the displacements are equal and opposite, the platen wave is totally compensated for. $\theta_1$ and $\theta_2$ are, in the example illustrated in FIG. 14, 90°. $\theta_1$ is a counterclockwise arc while $\theta_2$ is a clockwise arc, because of the direction of travel of the forms 16, as reviewed in FIG. 14. By predisplacement of the forms with the rollers 212, both the misregistration of the forms on the platen and with respect to the pins of the tractor belts are eliminated, thereby improving printing quality and providing for precision drive of the forms.

The platen wave roller has the additional feature of steering the forms to prevent lateral meandering thereof. In the event that the forms laterally meander, tending to skew the lines being printed thereon, the length of the path between the sprocket 82 and the platen and past the platen wave rollers 212 increases near one edge of the forms and decreases near the opposite edge. Consequently, the tension in the web and the force opposing the force F of the spring 216 increases, where the tension in the web increases, and decreases where the tension in the web decreases. With increasing tension in the web, because the length of the lever arm through the rollers 212 between the forms and the axis of rotation of the rollers decreases, the mechanical advantage increases and tends to become infinite. In other words, as the tension increases and the lever arm in this roller 212 (the distance between the line 220 and the forms) decreases. An ever increasing force is applied to the spring 216. The force exerted by the spring therefore increases and opposes the increasing tension. The form veers to the side at which the tension is increased. The platen wave rollers oppose any increase in the tension in the web, and by veering the forms, add tension where the tension in the web is low. The platen wave rollers therefore act as steering rollers to counteract any lateral meandering of the forms on the platen. The lines printed on the forms therefore remain straight.

The operation of the rollers 214 in performing the de-tenting function will become more apparent from FIG. 15. The spring 218 applies a force in the direction F and maintains a wrap of the forms about the detenting rollers in an arc of at least 90°. A positive tent would engage the lid and impose a high drag on the drive system, possibly overloading the motor thereof and causing it to stall. When such a positive tent reaches the de-tenting roller 214, it is forced upwardly as it travels around the de-tenting roller 214 into a negative tent which is readily compressed as it reaches the belt 84 on the inlet and of the tractors (the tractor 52 is illustrated, by way of example, in FIG. 15). The de-tenting roller 214 and its flexure 218 also relieve the starting load on the drive system and, during starting, decouple the tractors from the length of forms between the tractors and the stack of fan folded forms.

While support for the rollers 212 and 214 and their flexures from the support bar 30 is presently preferred, they may be supported from other devices in the unit, for example, the tractors or their support shaft 28.

Referring to FIGS. 16, 17 and 18 there is shown an overhead unit similar to the unit shown in FIGS. 1–15; like parts being identified by like reference numeral. The tractors are single lid or unidirectional type tractors **52*a* and 54*a*. The forms 16 are fed along a path which extends below the platen 12**.

In order to maintain the bow of the forms produced by the rollers 130 and 132, guide the forms into the tractors **52*a* and 54*a* and support the forms and prevent buckling thereof between the tear-off bar 172 and the platten 12, stiffening fingers 230 and 232 are provided. These fingers are bent away from the tractor lids 90 and curved at their free ends 234. The fingers are flexural members, like the flexural supports 216 and 218 for the rollers 212 and 214**.

The fingers 230 and 232 are mounted in assemblies 236 and 238 together with de-tenting rollers 214 and their flexures 240 and 242. The assemblies include clamp arrangements 244, similar to the arrangements used to clamp the assemblies 191, 193 and 195. The assemblies 236 and 238 are, however, clamped to and supported on the support shaft 28.

From the foregoing description it will be apparent that there has been provided improved forms feeding apparatus. The invention has been illustrated and embodied in an overhead unit for a computer printer. Other applications for the invention and various features thereof, as well as variations and modifications in the herein described apparatus, within the scope of the invention, will undoubtedly suggest themselves to those skilled in the art. Accordingly, the foregoing description should be taken as illustrative and not in a limiting sense.

I claim:

1. Continuous forms feeding apparatus for use with a platen which comprises tractors engagable with feed perforations along margins of the forms which are partially severed by side perforations, successive ones of the forms being defined by cross perforations which also partially sever the forms and enable them to be stacked in fan folded configuration, means connecting said tractors and platen in conjointly driven relationship for feeding said forms around said platen and through said tractors, means for bursting said side perforations, said bursting means being defined by flexural members and portions of said tractors, said flexural members being disposed in the path of said forms to oscillate in response to energy derived from said forms and repetitively burst said side perforations, means for enabling the bursting of said cross perforations operative for clamping said forms against said platen upstream of said cross perforations between said platen and said tractors and including a bar having a longitudinal edge engageable with said platen and pivotally mounted to define a toggle with said platen to increase the clamping force of said bar edge against said platen when said bar engages said form against said platen and when said form is pulled in said downstream direction to burst said cross perforations, means disposed upstream of said platen between said platen and said tractors yieldably biasing the surface of said forms opposite to the surface which bears against said platen into an arc sufficient to compensate the relative displacement of said forms linearly fed by said tractors and rotationally fed by said platen, flexurally supported means disposed upstream of said tractors on the opposite side of said tractors from said compensating means for inverting tents at the cross perforations in said forms, and means for bowing said forms to increase the stiffness thereof in the region thereof driven by said tractors and burst by said means for bursting said side perforations.

2. The apparatus according to claim 1 wherein said tractors have sprockets and belts with pins extending therefrom into said feed perforations of said forms, said feeding means having a drive shaft, said sprockets having a journal and a hole for receiving said drive shaft which extends through said journal, a pair of longitudinal slits in said journal intersecting diagonally opposite locations on the surface of said hole, and a tapered sleeve on said journal for controlling the cross-sectional area of said hole in said journal and the clearance between said drive shaft and said hole.

3. The apparatus according to claim 2 wherein said drive shaft and said hole through said journal have a rectilinear cross section with diagonally opposite corners, said journal having a tapered cylindrical outer peripheral surface, said journal having only one pair of said slits, one of which extends radially from said peripheral surface to one of said corners of said hole and the other extending radially from said peripheral surface to the other of said corners of said hole diagonally opposite thereto, said sleeve being cylindrical and having an internal taper to a diameter smaller than the diameter of said sleeve at one end thereof, one end being disposed adjacent to the end of said journal outward from said sprocket.

4. The apparatus according to claim 3 wherein said peripheral surface has an external thread and said sleeve has an internal thread, said threads being tapered to effect opening and closing of said slits when said journal and sleeve turn with respect to each other.

5. The apparatus according to claim 4 wherein said external thread has top and side surfaces with a pressure surface on the top and driving surfaces on the surfaces thereof, said internal thread has a pressure surface which engages the pressure surface of said external thread.

6. The apparatus according to claim 5 wherein said top and sides of said external thread defining an angle of 60°–90° therebetween.

7. The apparatus according to claim 1 wherein said shearing means each have a pair of blades, one blade of said pair being defined by an edge of said portion of said tractor which extends in the direction of travel of said form and the other blade by an edge of said flexural member.

8. The apparatus according to claim 7 wherein said flexural members are plates, said plates defining ramps over which the portions of said forms between the margins thereof travel from leading to trailing ends of said plates.

9. The apparatus according to claim 8, wherein said plates are cantilever mounted in the region of said trailing ends thereof.

10. The apparatus according to claim 9, wherein said portions of said tractors are the lids thereof, said plates being mounted on said lids with said ramps extending past edges of the sides of said lids facing said forms, said edges being the blade defining edges of said shearing means provided by said tractor portions.

11. The apparatus according to claim 10, wherein said tractors have opposite ends, said plates have opposites ends one of which is a leading end over which said forms first pass, said plates have lengths between their opposite ends less than the lengths of said tractors between the opposite ends of said tractors so that the leading ends of said plates terminate intermediate the ends of said tractors, said plates being disposed along a portion of the length of said tractors downstream in the direction of travel of said forms whereby a portion of said forms in the upstream direction remains unsevered along their side perforations as said forms travel through said tractors.

12. The apparatus according to claim 11 wherein said ramps are curved, having a curvature of a sector of a circular arc.

13. The apparatus according to claim 1 wherein said shearing means on one of said tractors and on the other of said tractors are offset from each other in the direction of travel of said forms sufficiently to extend the duration over which said energy is derived.

14. The apparatus according to claim 1 wherein said cross perforation bursting enabling means includes means defining a lever for pivoting said bar and connected thereto, said lever being disposed outwardly of said forms for actuation manually by one hand while the portion of one of said forms from which the margins are burst at said side perforations is grasped by the other hand, pulled in said downstream direction and torn along said cross perforations away from the form adjacent thereto which is clamped to said platen, the pulling increasing the clamping force applied to said form by said bar.

15. The apparatus according to claim 14 wherein said bar has a convex outer surface one end of which defines said longitudinal edge of said bar, said surface defining a guide for said forms in to said tractors when said edge is disengaged from said platen.

16. The apparatus according to claim 14 wherein said bar is pivotally mounted on a pivot axis parallel to the axis of rotation of said platen, said pivot axis being disposed to define in a plane perpendicular to said pivot axis and said platen axis a triangle the base of which is between said pivot axis and said platen axis and the sides of which are between the point of engagement of said longitudinal edge of said bar said pivot axis and said platen axis, respectively, said sides defining the links of said toggle, said sides extending in the upstream direction from said base so as to bring said links together to increase said clamping force when said forms are pulled in the downstream direction.

17. The apparatus according to claim 16 further comprising means connected to said bar providing a lever for pivoting said bar to bring said longitudinal edge of said bar into engagement with said platen.

18. The apparatus according to claim 17 wherein said bar has a convex outer surface one end of which defines said longitudinal edge, the included angle defined by said surface being an obtuse angle, the apex of said angle being disposed between said pivot axis and the axis of rotation of said platen and away from the base of said triangle in said downstream direction.

19. The apparatus according to claim 18 further comprising a frame connected to said bar and extending laterally along said bar for providing said lever.

20. The apparatus according to claim 1 wherein said forms define a loop around said platen, said tractors engaging the feed perforations in said forms at the opposite ends of said loop, and said compensating means extending into said loop between one of said opposite ends and said platen to increase the tension in said loop and wrap said forms into driving engagement with said platen.

21. The apparatus according to claim 20 wherein said arc is 90° or equal to the arc formed by said forms around said platen, whichever is less.

22. The apparatus according to claim 21 wherein said compensating means is at least one roller having its axis of rotation parallel to the axis of rotation of said platen, said spring means supporting and yieldably biasing said roller into said loop.

23. The apparatus according to claim 22 wherein said compensating means comprises a plurality of said rollers each with separate ones of said spring means in laterally spaced relationship in the direction axially of said platen, said rollers providing differential tension in said forms for steering said forms to counteract lateral displacement thereof on said platen.

24. The apparatus according to claim 23 further comprising a support bar extending laterally and parallel to the axis of rotation of said platen, said support bar being disposed intermediate the length of said tractors on the side thereof upstream of said platen, said spring means comprising flexures, said rollers being rotatably mounted, each to a different one of said flexures at one end thereof, and clamp means on said support bar for supporting said flexural members on said support bar, and pivotally adjustable mounting means for enabling said rollers to be positioned with respect to said loop to form said forms into said arc.

25. The apparatus according to claim 22 wherein said spring means comprises a flexure member rotatably mounted at one end to said roller and fixedly mounted at the end thereof opposite to said one end.

26. The apparatus according to claim 1 wherein said tractors have lids and belts, said belts having pins extending from said belts into said feed perforations, said forms extending from said tractors upstream of said platen into an end of said tractors between said lids and said belts, said means for inverting said tents being disposed in engagement with the side of said forms which faces said lids for inverting tents extending from said last named side of said forms.

27. The apparatus according to claim 26 wherein said inverting means comprises a flexure for biasing said inverting means against said one side of said forms, and pivotally adjustable means supporting said flexural member.

28. The apparatus according to claim 26 wherein said inverting means comprises at least one roller and spring means for biasing said roller against one side of said forms, said spring means and roller being disposed to contain a section of said forms which occupies an arc of at least 90° around said roller.

29. The apparatus according to claim 28 wherein said inverting means comprises a plurality of rollers laterally spaced from each other in the direction axially of said platen.

30. The apparatus according to claim 29 wherein said tractors are mounted on drive and support shafts extending in said direction axially of said platen, a support bar also extending in said direction axially of said platen and disposed outwardly of said tractors on the downstream side of said platen and intermediate the length of said tractors, said spring means being flexures, one for each of said rollers, said rollers being rotatably mounted each on one end of a different one of said flexures, and a plurality of clamp means laterally moveable on said support bar and each attached to the opposite end of a different one of said flexures for mounting it on said support bar.

31. The apparatus according to claim 30 wherein said means to compensate comprises a second plurality of rollers, a second plurality of flexures, said second plurality of rollers each being rotatably connected to a different one of said second plurality of flexures at an end thereof, the opposite ends of said second flexures being connected to different ones of said clamp means to provide assemblies of said inverting means rollers and compensating rollers and their flexures which are laterally displaceable along said support bar and fixedly connectable thereto.

32. The apparatus according to claim 1 further comprising drive and support shafts extending laterally of said platen parallel to the rotational axis thereof, said tractors being mounted in driven relationship with said drive shaft and on said support shaft, said tractors having belts on which one side of said forms are disposed and from which pins extend into said feed perforations, a frame and at least one sprocket through which said drive shaft extends, said frame and sprocket defining the radial distance from said one side of said forms to the axis of said drive shaft and the axis of said support shaft, said bowing means comprising at least one roller mounted on and rotatable with said drive shaft, said roller being disposed between said tractors and having a radius sufficiently greater than said radial distance to bow and stiffen said forms.

33. The apparatus according to claim 32 wherein a plurality of said rollers are provided each mounted on and rotatable with said drive shaft and each having said radius, said rollers being spaced from each other along said drive shaft.

34. The apparatus according to claim 33 further comprising a plurality of rollers rotatably mounted on said support shaft and spaced from each other along said support shaft, said rollers each having a radius sufficiently greater than said radial distance to bow and stiffen said forms.

35. The apparatus according to claim 32 further comprising at least one flexural finger extending between said tractors and said platen and engagable with the side of said form which engages said platen to maintain the bow of said forms.

36. Continuous forms feeding apparatus which comprises tractors engagable with feed perforations along margins of the forms which are partially severed by side perforations, means for feeding said forms through said tractors, and bursting means for bursting said side perforations, said bursting means being defined by flexural members and portions of said tractors, said flexural members being disposed in the path of said forms to oscillate in response to energy derived from said forms and repetitively shear said side perforations.

37. The apparatus according to claim 36 wherein said bursting means each have a pair of blades, one blade of said pair being defined by an edge of said portion of said tractor which extends in the direction of travel of said form and the other blade by an edge of said flexural member.

38. The apparatus according to claim 37 wherein said flexural members are plates, said plates defining ramps over which the portions of said forms between the margins thereof travel from leading to trailing ends of said plates.

39. The apparatus according to claim 38, wherein said plates are cantilever mounted in the region of said trailing ends thereof.

40. The apparatus according to claim 39, wherein said tractors have lids said portions of said tractors are the lids thereof, said plates being mounted on said lids with said ramps extending past edges of the sides of said lids facing said forms, said edges being the blade defining edges of said bursting means provided by said tractor portions.

41. The apparatus according to claim 40, wherein said tractors have end where said forms enter and exit, said plates are shorter than said tractors so that the end thereof which faces upstream in the direction of the feeding of said forms, terminates intermediate the ends of said tractors, said plates being disposed along a portion of said tractor adjacent the exit ends whereby a portion of said forms adjacent to the entry ends remains unsevered along their side perforation as said forms travel through said tractors.

42. The apparatus according to claim 41 wherein said ramps are curved, having a curvature of a sector of a circular arc.

43. The apparatus according to claim 36 wherein said shearing means on one of said tractors and on the other of said tractors are offset from each other in the direction of travel of said forms sufficiently to extend the duration over which said energy is derived.

44. The apparatus according to claim 32 wherein said flexural members are sloped with respect to the path of said forms through said tractors and present a non-straight curvature to said path.

45. Continuous forms feeding apparatus for use with a platen which comprises tractors engageable with feed perforations along margins of the forms, successive ones of the forms being defined by cross perforation which also partially sever the forms and enable them to be stacked and fan folded configuration, means for feeding said forms around said platen and through said tractors, means for enabling the bursting of said cross perforation operative for clamping said forms against said platen upstream of said cross perforation between said platen and said tractors and including a bar having a longitudinal edge engageable with said platen and pivotally mounted to define a toggle with said platen which causes the clamping force of said bar edge against said platen to increase when said bar engages said form against said platen and when said form is pulled in the downstream direction to burst said said cross perforation.

46. The apparatus according to claim 45 wherein said cross perforation bursting enabling means includes means defining a lever for pivoting said bar and connected thereto, said lever being disposed outwardly of said forms for actuation manually by one hand while the portion of one of said forms is grasped by the other hand, pulled in said downstream direction and torn along said cross perforation away from the form adjacent thereto which is clamped in said platen, the clamping force applied to said form by said bar.

47. The apparatus according to claim 46 wherein said bar has a convex outer surface one end of which defines said longitudinal edge of said bar, said surface defining a guide for said forms in to said tractors when said edge is disengaged from said platen.

48. The apparatus according to claim 46 wherein said bar is pivotally mounted on a pivot axis parallel to the axis of rotation of said platen, said pivot axis being disposed to define in a plane perpendicular to said pivot axis and said platen axis a triangle the base of which is between said pivot axis and said platen axis and the sides of which are between the point of engagement of said longitudinal edge of said bar said pivot axis and said platen axis, respectively, said sides defining the links of said toggle, said sides extending in the upstream direction from said base so as to bring said links together to increase said clamping force when said forms are pulled in the downstream direction.

49. The apparatus according to claim 48 further comprising means connected to said bar providing a lever for pivoting said bar to bring said longitudinal edge of said bar into engagement with said platen.

50. The apparatus according to claim 49 wherein said bar has a convex outer surface one end of which defines said longitudinal edge, the included angle defined by said surface being an obtuse angle, the apex of said angle being disposed between said pivot axis and the axis of rotation of said platen and away from the base of said triangle in said downstream direction.

51. The apparatus according to claim 50 further comprising a frame connected to said bar and extending laterally along said bar for providing said lever.

52. Continuous forms feeding apparatus for use with a platen which comprises tractors engageable with feed perforations along margins of the forms, means connecting said tractors and platen in conjointly driven relationship for feeding said forms around said platen and through said tractors, one surface of said forms bearing against said platen and forming a first arc around said platen, and means disposed upstream of said platen between said platen and said tractors yieldably biasing the surface of said forms opposite to the surface which bears against said platen into a second arc in an opposite sense to said first arc and sufficient to compensate the relative displacement of said forms linearly fed by said tractors and rotationally fed by said platen.

53. The apparatus according to claim 52 wherein said forms define a loop around said platen, said tractors engaging the feed perforations in said forms at the opposite ends of said loop, and said compensating means extending into said loop between one of said opposite ends and said platen to increase the tension in said loop and wrap said forms into driving engagement with said platen.

54. The apparatus according to claim 53 wherein said second equal to first arc is 90° or the arc formed by said forms around said platen, whichever is less.

55. The apparatus according to claim 54 wherein said compensating means is at least one roller having its axis of rotation parallel to the axis of rotation of said platen, and spring means supporting and yieldably biasing said roller into said loop.

56. The apparatus according to claim 55 wherein said compensating means comprises a plurality of said rollers each with separate ones of said spring means in laterally spaced relationship in the direction axially of said platen, said rollers providing differential tension in said forms for steering said forms to counteract lateral displacement thereof on said platen.

57. The apparatus according to claim 56 further comprising a support bar extending laterally and parallel to the axis of rotation of said platen, said support bar being disposed intermediate the length of said tractors on the side thereof upstream of said platen, said spring means comprising flexure, said rollers being rotatably mounted, each to a different one of said flexure at one end thereof, and clamp means on said support bar for supporting said flexural members on said support bar, and pivotally adjustable mounting means for enabling such rollers to be positioned with respect to said loop to form said forms into said arc.

58. The apparatus according to claim 55 wherein said spring means comprises a flexure rotatably mounted at one end to said roller and fixedly mounted at the end thereof opposite to said one end.

59. Continuous forms feeding apparatus which comprises tractors engageable with feed perforations along margins of the forms which are partially severed by side perforations, means connected to said tractors for feeding said forms through said tractors, flexurally supported means disposed upstream of said tractors for inverting tents at the cross perforations in said forms and relieving the starting load of said forms on said tractors, said tractors having lids and belts, said belts having pins extending from said belts into said feed perforations, said means for inverting said tents being disposed in engagement with the side of said forms which faces said lids for inverting tents extending from said last name side of said forms, and said inverting means comprising at least one roller and spring means for biasing said roller against said last named side of said forms, said spring means and roller being disposed to contain a section of said forms which occupies an arc of at least 90° around said roller.

60. The apparatus according to claim 59 wherein said roller is one of a plurality of rollers laterally spaced from each other in the direction axially of said roller.

61. The apparatus according to claim 60 wherein said tractors are mounted on drive and support shafts extending in said direction axially of said rollers, a support bar also extending in said direction axially of said rollers, said support bar being disposed outwardly of said tractors upstream of said tractors, said spring means being a plurality of flexures, one for each of said rollers, said rollers being rotatably mounted each on one end of a different one of said flexures, and a plurality of clamp means laterally movable on at least one of said support shaft and said support bar and each attached to the opposite end of a different of one of said flexures for mounting it on said one of said support bar and shaft.

62. The apparatus according to claim 61 further comprising platen wave compensating means which comprises a second plurality of rollers, a second plurality of flexures, said second plurality of rollers each being rotatably connected to a different one of said second plurality of flexures at one end thereof, the opposite ends of said second flexures being connected to different ones of said clamp means to provide assemblies of different ones of said first plurality of rollers of said tent inverting means, and said second plurality of rollers and their flexures which are laterally displaceable along said support bar and fixedly connectable thereto.

63. Continuous forms feeding apparatus which comprises tractors engageable with feed perforations along margins of the forms, means connected to said tractors for feeding sad forms through said tractors, means disposed between said tractors for bowing said forms to increase the stiffness thereof and the region thereof driven by said tractors, said forms being engageable with a platen having a rotational axis, and further comprising drive and support shafts extending laterally of said platen parallel to the rotational axis thereof, said drive and support shaft each having an axis, said tractors being mounted and in driven relationship with said drive shaft and on said support shaft, said tractors having belts on which one surface of said forms are disposed and from pins extend into said feed perforations, a frame and at least one sprocket through which said drive shaft extends, said frame and sprocket defining the radial distance from said drive shaft axis to said one surface of said forms and the radial distance from the axis of said support shaft to said one surface of said forms, said bowing means comprising at least one roller mounted on and rotatable with said drive shaft, said roller being disposed between said tractors and having a radius sufficiently greater than said radial distance to bow and stiffen said forms.

64. The apparatus according to claim 63 wherein a plurality of said rollers are provided each mounted on and rotatable with said drive shaft and each having said radius, said rollers being spaced from each other along said drive shaft.

65. The apparatus according to claim 64 further comprising a plurality of rollers rotatably mounted on said support shaft and spaced from each other along said support shaft, said rollers each having a radius sufficiently greater than said radial distance to bow and stiffen said forms.

66. The apparatus according to claim 64 further comprising support means extending from said roller towards said platen adjacent to the region where said forms leave said platen for engaging the same side of said forms which engages said platen to maintain said bowing in proximity to said platen, said support means being flexure fingers disposed between said rollers.

67. The apparatus according to claim 63 further comprising support means extending from said roller towards said platen adjacent to the region where said forms leave said platen for engaging the same side of said forms which engages said platen to maintain said bow in proximity to said platen.

68. Continuous forms feeding apparatus which comprises tractors engageable with feed perforations along margins of the forms, said tractors having sprockets and belts with pins extending therefrom into said feed perforations of said forms, said drive means having a drive shaft, said sprockets having a journal, a hole which extends through said journal for receiving said shaft in driving relationship with said sprockets, a pair of longitudinal slits in said journal intersecting diagonally opposite locations on the surface of said hole, and a tapered sleeve on said journal for controlling the cross sectional area of said hole in said journal and the clearance between said drive shaft and said hole.

69. The apparatus according to claim 68 wherein said drive shaft and said hole through said sprocket each have a rectilinear cross section with diagonally opposite corners, said journal having a cylindrical outer peripheral surface, said journal only having one pair of said slits, one of which extends radially from said peripheral surface to one said corners of said hole and the other extending radially from said peripheral surface to the other of said corners of said hole diagonally opposite thereto, said sleeve being cylindrical and having an internal taper to a diameter smaller than the diameter of said sleeve at one end thereof, said one end being disposed adjacent to the end of said journal outward of said sprocket.

70. The apparatus according to claim 69 wherein said peripheral surface has an external thread and said sleeve has an internal thread, said thread being tapered to effect opening and closing of said slits when said journal and sleeve are turned with respect to each other.

71. The apparatus according to claim 69 wherein said external thread has a pressure surface on the top and driving surfaces on the sides thereof, said internal thread has a pressure surface which engages the pressure surface of said external thread.

72. The apparatus according to claim 71 wherein said top and sides of said external thread define an angle of from about 60° to 90° therebetween.

73. Continuous forms feeding apparatus which comprises tractors engageable with feed perforations along margins of the forms, means connected to said tractors for feeding said forms through said tractors, and means disposed between said tractors for bowing said forms to increase the stiffness thereof in the region thereof driven by said tractors, said forms also being engageable with a platen, and further comprising at least one flexure finger extending between said tractors and said platen and engageable with the surface of said forms which engages said platen to maintain the bowing of said forms.

* * * * *